US005178294A

United States Patent [19]

Hill et al.

[11] Patent Number: 5,178,294

[45] Date of Patent: Jan. 12, 1993

[54] PACKAGING CONTAINER

[75] Inventors: Joseph A. Hill, Portland Works; Johnathan R. Wood, Great Longstone, both of England

[73] Assignee: Robinson & Sons Ltd., Derbyshire, United Kingdom

[21] Appl. No.: 779,003

[22] PCT Filed: May 18, 1990

[86] PCT No.: PCT/GB90/00775

§ 371 Date: Nov. 15, 1991

§ 102(e) Date: Nov. 15, 1991

[87] PCT Pub. No.: WO90/14294

PCT Pub. Date: Nov. 29, 1990

[30] Foreign Application Priority Data

May 18, 1989 [GB] United Kingdom ..... 8911489
Oct. 27, 1989 [GB] United Kingdom ..... 8924279

[51] Int. Cl.[5] ..... B65D 5/50

[52] U.S. Cl. ..... 220/469; 220/410; 229/902; 229/903; 426/113

[58] Field of Search ..... 229/902, 903; 220/410, 220/415, 469; 426/107, 113; 99/10.55 E

[56] References Cited

U.S. PATENT DOCUMENTS

| | | | |
|---|---|---|---|
| 3,670,881 | 6/1972 | Dutcher | 229/125.17 |
| 3,938,730 | 2/1976 | Detzel et al. | 229/903 |
| 4,202,465 | 5/1980 | McLaren | 229/903 |
| 4,257,530 | 3/1981 | Faller | 220/469 |
| 4,431,114 | 2/1984 | Kleinfeld | 220/337 |
| 4,496,815 | 1/1985 | Jorgensen | 426/107 |
| 4,756,446 | 7/1988 | Gen et al. | 220/469 |
| 4,821,884 | 4/1989 | Griffin et al. | 229/903 |
| 4,866,232 | 9/1989 | Stone | 219/10.55 E |

FOREIGN PATENT DOCUMENTS

| | | |
|---|---|---|
| 268427 | 5/1988 | European Pat. Off. . |
| 2312217 | 9/1974 | Fed. Rep. of Germany . |
| 8807472 | 10/1988 | PCT Int'l Appl. . |

*Primary Examiner*—Gary E. Elkins
*Attorney, Agent, or Firm*—Watson, Cole, Grindle & Watson

[57] ABSTRACT

A packaging container particularly suitable for retail sale of pre-prepared foodstuffs comprises an inner generally cup-like portion (2) located substantially entirely within an outer portion (3). The inner portion is formed of a microwave compatible plastics material and is retained within the outer portion e.g. by flaps (12) formed integrally with the outer portion which engage barbs provided on the inner portion. The air gap provided between the inner and outer portions prevents the outer portion from being heated by contact with the food product and accordingly the container can readily be handled after microwave heating of the contents.

8 Claims, 2 Drawing Sheets

PACKAGING CONTAINER

This invention relates to a packaging container and in the preferred embodiment provides a packaging container which is particularly suitable for the packaging for retail sale of pre-prepared foodstuffs.

Many pre-prepared foodstuffs are sold in a ready-to-heat form, and may be heated either in a conventional oven or a microwave oven. Heating of such foodstuffs in a microwave oven has many well recognized advantages, and it has been found to be particularly advantageous if foodstuffs which are susceptible to being heated in a microwave oven are sold packaged in a container in which the products may be heated using a microwave oven. Certain plastics materials are well suited to the formation of such containers since they can readily and cheaply be formed into a water-tight dish-like container, are not adversely affected by microwave energy, and are able to withstand contact with the product even when the temperature of the product has been raised to boiling point. However, simple plastics containers known heretofore for microwavable food products have suffered from the disadvantage that they readily conduct heat with the result that the temperature of the outside surface of the container rises substantially to the temperature of the contents of the container during microwave heating. It is accordingly very difficult to remove the container from the microwave oven after heating. In this respect, it will be appreciated that many of the plastics suitable for formation of such containers are thermoplastic in nature, and accordingly the containers will soften at elevated temperatures. Such softening makes the containers highly flexible, and great care must be taken when removing the container from the microwave oven in order to avoid spillage of the product. Such careful removal will necessitate careful grasping of the container, and this is difficult if the outer surface temperature of the container approaches that of the heated contents.

A similar problem arises in relation to dehydrated food products which are sold in a pot to which boiling water is added in order to re-hydrate the food product. The temperature of the outside surface of such containers will become very high, and the containers themselves will soften at elevated temperature rendering handling of such containers difficult.

According to the present invention a packaging container comprises an inner plastics generally dished portion having an open upper end, a closed lower end, and side walls interconnecting the upper and lower ends; and an outer portion having an open upper end, a closed lower end, and side walls interconnecting the upper and lower ends, wherein the inner portion is in contact with the outer portion at the upper end of the container and the side walls of the inner portion are spaced from the side walls of the outer portion by an air gap, the inner portion being engagingly retained in the outer portion by a mechanical interlock with the outer portion, the interlock being provided by flaps which extend from the upper end of the outer portion downwardly and inwardly to engage the outer surface of the inner portion at a point intermediate the upper and lower ends.

With such a container, the outer surface of the side walls will be substantially thermally isolated from the contents of the container by the air gap and accordingly the outer side walls of the container will remain cool to touch. Further, because the outer portion is not heated significantly during microwave heating of the contents of the container, the physical properties of the outer portion will not be adversely affected with the result that the container will remain rigid and easy to handle, notwithstanding that the temperature of the contents may be at or close to the boiling point thereof.

In one preferred embodiment of the invention the outer portion is of carton board and the inner portion rests on the upper edge of the outer portion and is supported thereby. In this case, the lower closed end of the inner portion is preferably spaced from the lower end of the outer portion. In this way, the temperature of the lower surface of the carton board outer portion will also remain low during heating of the carton and contents. Preferably, the lower end of the inner portion is spaced from the lower end of the outer portion by an air gap, and the weight of the inner portion is entirely supported on the upper edge of the outer portion.

Preferably, the air gap between the inner and outer portions is provided by a substantially closed chamber defined between the inner and outer portions.

The inner portion is secured to the outer portion by the flaps in a manner which ensures that the inner portion is retained within the outer portion if the container is inverted to remove the contents. A suitable projection may be formed on the inner portion to engage the free edge of each flap and resist separation of the inner portion from the outer portion. Each projection may be shaped like a barb.

In a particularly preferred embodiment of the invention the lower end of the inner portion is of a smooth curved concave form when viewed from the open end of the inner portion. This arrangement is advantageous from the point of providing even microwave heating of the contents, and offers the further advantage that the contents can easily be removed from the container using a spoon. It will be appreciated that such an arrangement is not possible in the case of a single-walled container since the container would not, if it had this form, stand on its base.

Preferably, the upper edge of the inner portion is in the form of an outwardly directed flange. Such a flange provides a surface to which a cover can be sealed, e.g. by heat sealing, adhesive sealing, or ultrasonic welding. The cover may be of any convenient form, for example a plastic laminate membrane, a paperboard/plastic laminate, treated paperboard, or metal foil. If the closure is of a form compatible with microwave heating then the closure may be left in position during microwave heating provided that a suitable vent hole is provided. Preferably, the carton is completely sealed by the closure when sold, and the vent hole is formed by partially breaking the seal between the closure and the container, or by forming an aperture in the closure itself.

Whilst particularly suitable for the retail sale of microwave heatable foodstuffs it will be appreciated that the packaging containers of the present invention are of more general applicability. For example, the containers can conveniently be used for the retail sale of dehydrated foodstuffs which are re-hydrated by the addition of boiling water. The containers of the present invention are particularly desirable for this purpose since the thermal insulation provided by the air gaps surrounding the inner portion substantially reduces any undesirable cooling of the contents during the re-hydration period. This thermal insulation is also of advantage in relation to microwave heated products in that it delays cooling of the product after heating.

The containers of the present invention may also be advantageously adopted for cold or frozen foodstuffs, for example dessert products.

The invention will be better understood from the following description of a preferred embodiment thereof, given by way of example only, reference being had to the accompanying drawings wherein.

Figure 1:
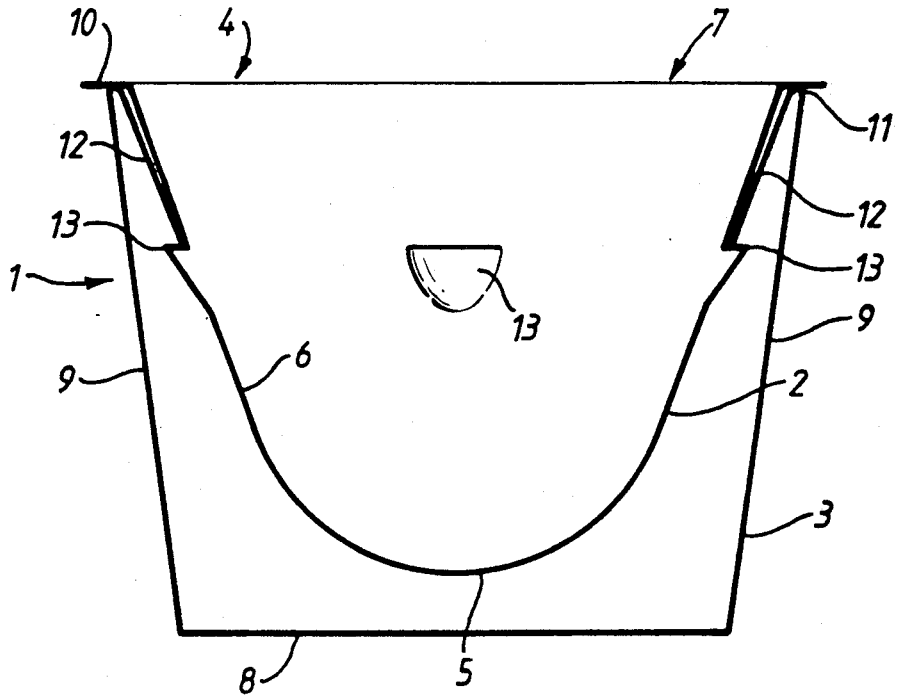
FIG. 1 is a cross-section taken on the line 1—1 of FIG. 2 illustrating a preferred embodiment of the invention.
Figure 2:
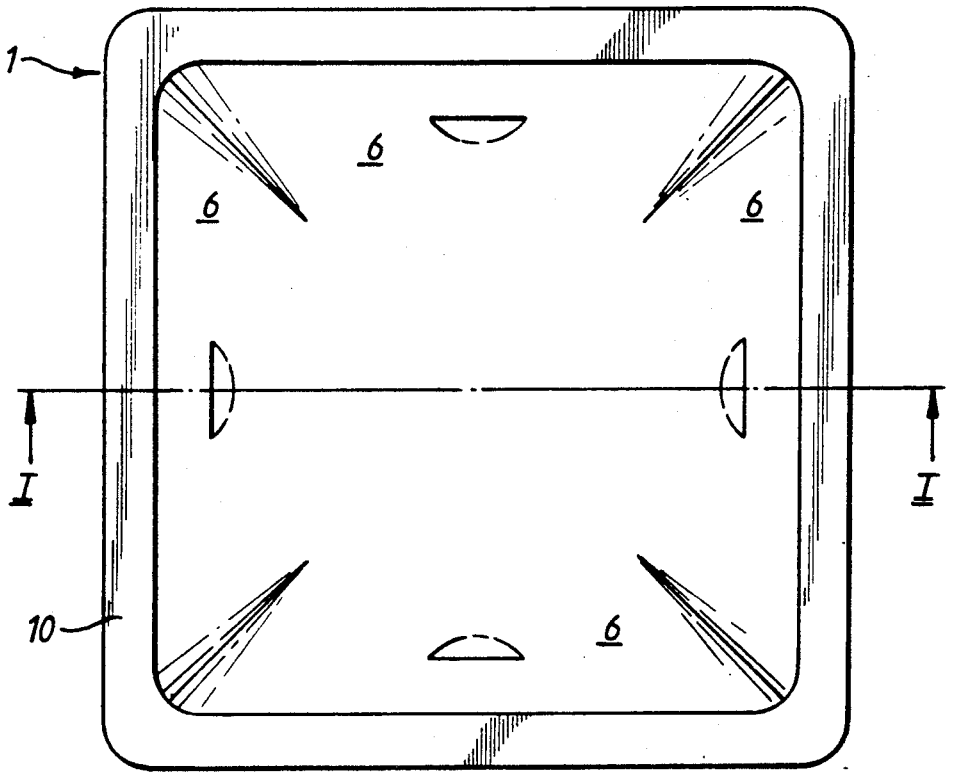
FIG. 2 is a plan view of the embodiment of FIG. 1.

Referring firstly to FIGS. 1 and 2 the packaging container 1 comprises an inner generally cup-like portion 2 located substantially entirely within a cartonboard outer portion 3. The inner portion 2 is formed of a plastics material which is capable of containing foodstuffs whilst the container is subject to microwave heating to raise the temperature of the foodstuffs. Suitable plastics materials will be well known to those skilled in the art. The inner portion 2 can conveniently be formed by thermo-forming, but may be formed by other forming techniques, for example injection moulding.

The outer portion 3 is formed from carton board of a type which is able to withstand microwave energy.

The inner portion 2 has an open upper end 4 and a closed lower end 5 interconnected by side walls 6. In the illustrated embodiment of the invention the upper open end of the inner portion is substantially square and the closed lower end is in the form of a smooth concave surface when viewed from the open end. The side walls 6 blend from the square upper end into the rounded lower end. Whilst other configurations for the inner portion are possible, for example the open end may be of any convenient polygonal form, or round, and the closed end may correspond in shape to the upper end or have some different shape, the illustrated arrangement is particularly desirable since it will enable the carton to stack neatly in outer cases or on the shelf in a shop, but will provide an optimum shape for microwave heating of the contents and will enable the contents to be cleanly and easily removed from the carton using a spoon.

The outer portion 3 comprises an open upper end 7, a closed lower end 8 and side walls 9 interconnecting the upper and lower ends. In the illustrated embodiment the outer portion is in the form of an inverted truncated square based pyramid—i.e. it is square when viewed in horizontal cross-section and tapers inwardly from the open end 7 towards the closed end 8.

The inner portion of the container is in contact with the outer portion at the upper end of the container, and in the illustrated embodiment this is achieved by means of an outwardly extending flange 10 which extends around the entire periphery of the inner portion and rests on the upper edge 11 of the outer portion. The side walls 6 of the inner portion are spaced from the side walls 9 of the outer portion by an air gap. In the illustrated embodiment the lower end 5 of the inner portion is also spaced from the lower end 8 of the outer portion by an air gap. Whilst the provision of an air gap between the lower end 5 of the inner portion and the lower end 8 of the outer portion is desirable it should be understood that this is not an essential feature of the present invention, and many of the advantages of the invention can be derived if the lower end 5 of the inner portion rests on the lower end 8 of the outer portion, or rests on some intervening member, e.g. of insulating material. The provision of the air gap provides a large degree of thermal insulation between the manually graspable external surfaces of the container and the contents. In the case of a container which is filled with pre-prepared microwavable food this offers the particular advantage that after the container and food have been heated in a microwave oven the external surface of the container may be grasped to remove the container from the microwave oven without any discomfort to the user.

Further, the insulating effect of the air gap will assist in maintaining the temperature of the contents of the container, if the temperature of the contents is different from ambient temperature. In the case of pre-prepared chilled food this has the particular advantage that the insulation provided by the container will assist in keeping the contents cool between the time when they are removed from the retailer's chilled storage system and the time when they are placed in the domestic refrigerator of the purchaser, or are heated by the purchaser. After heating, the thermal insulation provided by the air gap will lengthen the period during which the contents will remain hot.

It will be appreciated that the illustrated container may also be used for many purposes other than pre-prepared microwavable foodstuffs. For example, the container may be used to pack dehydrated foodstuffs which are re-hydrated by the addition of boiling water. The thermal insulation provided by the air gap surrounding the side walls of the inner portion will then prevent discomfort to the person holding the container and will retard cooling of the contents of the container during the necessary dwell period for complete re-hydration. The container may also be used for cold products, for example frozen or chilled desserts. Finally, the container may be found to have uses outside the foodstuffs industry, for example it may be used to package such items as hyacinth bulbs which, after being "prepared" by a heat treatment process must be maintained at a relatively low temperature before they are planted.

The inner portion is secured to the outer portion to prevent accidental separation of the inner and outer portions. This is achieved by a mechanical interlock between the inner and outer portions provided by means of flaps 12 provided on the outer portion. These flaps are bent inwardly during assembly of the outer portion. The inner portion is formed with outwardly extending barb like projections 13 which, when the inner portion is pushed into the outer portion, cam the flaps 12 outwardly until the barb like portions clear the lower ends of the flaps, whereupon the flaps 12 spring back to the illustrated position and prevent removal of the inner portion from the outer portion.

Figure 3:
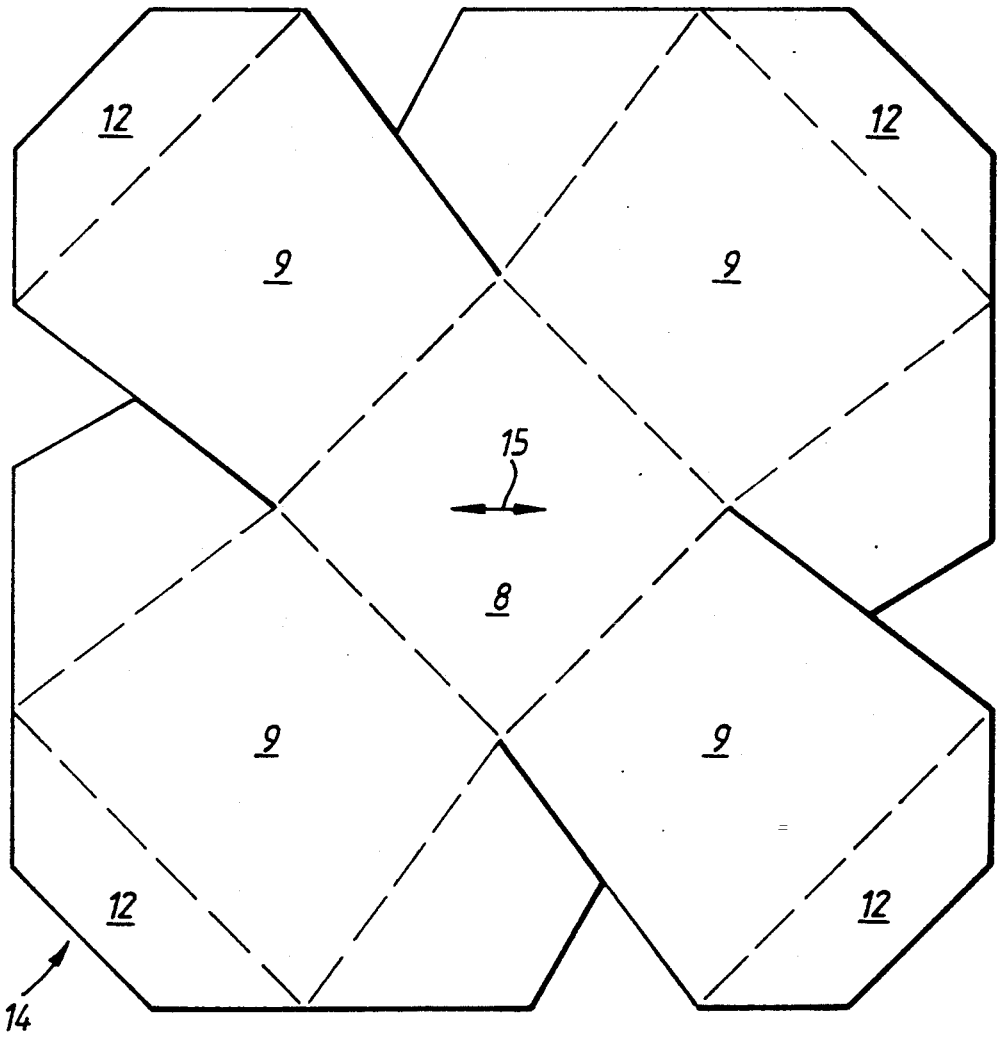
FIG. 3 illustrates on a smaller scale a blank for use in forming the outer portion of the container of FIGS. 1 and 2.

The form of mechanical interlock illustrated is particularly desirable since it can be achieved using a carton board blank 14 as illustrated in FIG. 3 which blank 14 can be cut from a sheet of carton board economically. It will be noted that by orientating the base 8 of the carton diagonally relative to the grain direction 15 of the carton board the blank 14 may be cut from a superficial area of carton board no larger than that which would be required to cut the blank without flaps 12. The flaps 12 are, in effect, formed by material which would be cut to waste if a blank devoid of the flaps was produced. This accordingly enables the blank to be cut, with flaps 12 for securing the inner portion to the outer portion, without any additional cost to the manufacturer.

In use, after the inner portion 2 has been charged with the product to be sold the open end 4 is closed by means of a suitable closure. It will be noted that the horizontal surface provided by the flange 10 provides a surface against which a range of conventional closures can be sealed. The open end 4 may, for example, be sealed by means of a plastic film or a plastic/foil laminate, or by means of a carton board lid having a plastic coated surface or a surface treated to render it compatible with sealing by adhesive, heat sealing or ultrasonic welding to the upper surface of the flange 10. In a particularly preferred embodiment of the invention the open end 4 is closed by means of a carton board closure which is scored to provide ready removal of the lid. Preferably, the lid is such that it can readily be punctured or partly opened to provide a ventilation opening prior to microwave heating of the container and contents. If desired, a clip-over additional lid may be provided over the primary closure. In the event that the primary closure is a foil or plastic film/foil laminate, the primary closure should be completely removed prior to microwave heating. In this case, the clip-over additional lid may be used to close the container during microwave heating. In addition, the clip-over lid can be used to re-close the container after opening.

The above described container may be found to be particularly advantageous for the sale of foodstuffs which have been subject to autoclave heating. In particular, the foodstuff may be loaded into the cup-like portion 2 and subjected to autoclave heating and sealing by means of a suitable lid before the inner portion 2 is loaded into the outer portion 3. During autoclave heating the inner portion 2 may be supported in a complementary shaped support member e.g. of metal, to prevent undesirable stretching of the plastics material of the inner portion 2 when the temperature of the inner portion and the contents are raised to the autoclave temperature. By this means, a container may be sold in which the contents have been subject to autoclave heating, and yet in which the outer portion 1 has not been subject to autoclave heating. Of course, the advantages outlined above in relation to microwave heating of the container still apply to container of products which have been subject to autoclave sterilization.

It will be noted that in the embodiment described above the lower surface of the inner portion is spaced from the base of the container. Whilst this feature is not essential and workable embodiments of the invention can be produced in which the lower surface of the inner portion rests on the inner surface of the base of the container, the feature of spacing the lower surface of the inner portion from the base of the container offers a particular and significant advantage in the efficient use of a microwave oven to heat the contents of the container. It is well recognized that for most efficient utilization of the microwave energy produced by a microwave oven the item to be heated should be held above the base of the microwave oven. To achieve this it is often necessary to stand the product being heated on some form of spacer, e.g. an upturned plate. Embodiments of the invention in which the lower surface of the inner portion is spaced from the base of the container automatically achieve this effect.

We claim:

1. A packaging container comprising: an inner plastics generally dished portion having an open upper end, a closed lower end, and side walls interconnecting the upper and lower end of the inner portion; and an outer portion having an open upper end, a closed lower end, and side walls interconnecting the upper and lower ends of the outer portion, wherein the inner portion is in contact with the outer portion at the upper end of the outer portion and the side walls of the inner portion are spaced from the side walls of the outer portion by an air gap, the inner portion being retained in the outer portion by a mechanical interlock with the outer portion, the interlock being provided by flaps which extend from the upper end of the outer portion downwardly and inwardly to engage projections on at least two of the side walls of the inner portion at a point intermediate the upper and lower ends of the inner portion.

2. A packaging container according to claim 1 wherein the outer portion is of carton board and the inner portion rests on the upper end of the outer portion and is supported thereby.

3. A packaging container according to claim 1 wherein each of the projections is barb shaped.

4. A packaging container according to claim 1, wherein the lower closed end of the inner portion is spaced from the lower end of the outer portion.

5. A packaging container according to claim 1, wherein the lower end of the inner portion is of a smooth curved concave form when viewed from the open end of the inner portion.

6. A packaging container according to claim 1, wherein the upper edge of the inner portion is in the form of an outwardly directed flange to which a cover can be sealed.

7. A packaging container according to claim 1, wherein the lower closed end of the inner portion is spaced from the lower end of the outer portion by an air gap, the inner portion being entirely supported on the upper end of the outer portion.

8. A packaging container according to claim 7 wherein the air gap between the inner and outer portions is provided by a substantially closed chamber defined between the inner and outer portions.

* * * * *